US007726471B2

(12) United States Patent
Srungaram

(10) Patent No.: US 7,726,471 B2
(45) Date of Patent: Jun. 1, 2010

(54) SOAPBOX

(76) Inventor: Suryaprasad Rao Srungaram, 4115 Stone Haven Dr., Garland, TX (US) 75043

( * ) Notice: Subject to any disclaimer, the term of this patent is extended or adjusted under 35 U.S.C. 154(b) by 144 days.

(21) Appl. No.: 11/970,578

(22) Filed: Jan. 8, 2008

(65) Prior Publication Data

US 2009/0173644 A1 Jul. 9, 2009

(51) Int. Cl.
*A47K 5/08* (2006.01)
*A47K 1/04* (2006.01)
*B65D 6/00* (2006.01)

(52) U.S. Cl. ..... 206/77.1; 4/628; 220/676

(58) Field of Classification Search ..... 206/77.1; 220/212, 628, 630, 638, 744
See application file for complete search history.

(56) References Cited

U.S. PATENT DOCUMENTS 1,311,666 A * 7/1919 Perkins ..... 312/240
2,930,160 A * 3/1960 Pohl ..... 206/77.1
3,688,895 A * 9/1972 Wilson ..... 206/37
3,899,073 A * 8/1975 Barr ..... 206/77.1
4,344,529 A * 8/1982 Ibarzabal ..... 206/77.1
5,752,602 A * 5/1998 Ackermann et al. ..... 206/507
6,152,294 A * 11/2000 Weinberg ..... 206/77.1
D450,965 S 11/2001 Weinberg
6,640,975 B2 * 11/2003 Bennett et al. ..... 206/509
6,966,445 B1 * 11/2005 Johanna ..... 211/85.12
D553,889 S 10/2007 Egawa
2007/0056862 A1 3/2007 Jones
2008/0083628 A1 * 4/2008 Sines ..... 206/77.1
2008/0314769 A1 * 12/2008 Lenard ..... 206/77.1

* cited by examiner

*Primary Examiner*—Ehud Gartenberg
*Assistant Examiner*—Jose S Stephens, III
(74) *Attorney, Agent, or Firm*—IP Authority, LLC; Ramraj Soundararajan; Geoff Trotter

(57) ABSTRACT

This soapbox is capable of draining wet bar soaps very quickly and efficiently and keeps water away from the surface of the bar soap. The unique design of the soap rack and its rack-bars keep the soap bar significantly dry and minimizes the wastage of soap. After its use, the bar soap will be conveniently stored in a compact, watertight box without the worry of spoiling the surroundings with the soapy water.

8 Claims, 5 Drawing Sheets

SOAP BOX DURING USE

SOAP BOX AFTER USE

THE SOAPBOX

PLAN VIEW

SECTION - XX

SECTION - YY

SOAP BOX DURING USE

SOAP BOX AFTER USE

SOAPBOX

REFERENCES CITED

| | | | |
|---|---|---|---|
| 1608928 | SOAP TRAY | Nov. 30, 1926 | Washburn Company of Worcester |
| 4133443 | Soap dish | Jan. 9, 1979 | Medina, et al. |
| 4331232 | Soap dish | May 25, 1982 | Larkin |
| 4422546 | Soap dish | Dec. 27, 1983 | Charity |
| 4938346 | Wall mounted soap dish | Aug. 3, 1990 | Urbano |
| 4993546 | Self draining soap dish | Feb. 19, 1991 | Southard |
| 5181606 | Soap dish | Jan. 26, 1993 | Martell |
| 5232189 | Pliable wire soap holder | Aug, 3, 1993 | Koch |
| 5253752 | Soap dish | Oct. 19, 1993 | Jang |
| 5377367 | Soap dish for use with hand-shower wall assembly | Jan. 3, 1995 | Bischoff |
| 5680929 | Soap Dish | Oct. 28, 1997 | Von Seidel |
| 6152294 | TRAVEL SOAP DISH ASSEMBLY | Nov. 28, 2000 | Weinberg |
| 6662940 | Draining soap dish for multiple bars of soap | Dec. 16, 2003 | KOWAL |

The soapbox is comprised of three separate parts, the bottom dish, the soap rack and the top cover. Each of these parts may be manufactured out of metal, plastic or any other material. The essential requirement is to maintain the shape and design of the soapbox components as shown on the drawings. The inventor developed this design for standard soap bars available on the market today, but could easily be modified to suit the available soaps or any other wet objects to be drained and dried.

The rack-bars must be semi-circular with the flat surface touching the soap or any other wet object to be drained efficiently. The diameter of the semi-circular rack-bars and the rack-bar spacing may be varied depending on the requirements.

The slope of the soap rack shown on these drawings is approximately 27 degrees but could be modified to any other slope in order to drain efficiently. The inventor selected this angle so that the soap rack can be conveniently stored in the same bottom dish for storage.

The other essential requirement of this design is to provide the overflow opening at least few mm below the bottom of the main supporting member of the soap rack so that even accidental overfill will not reach the soap. The top cover has an opening that will line up with the bottom dish overflow opening when the inverted top cover is placed under the bottom dish.

In order to make the rack-bars non-stick, any State-of-the-Art procedures may be utilized depending on the material used for the rack-bars.

OBJECT OF THE INVENTION

The object of this invention is to provide a simple but effective design to drain and dry wet objects especially wet bar soaps. Although the inventor developed the design of the soap supporting rack for the soapbox, the drain rack design may be effectively used to drain and dry any other wet objects including objects in the dehydrators.

BACKGROUND OF THE INVENTION

Ever since the discovery of bar soap, inventors are trying to develop a soapbox that can drain, dry and store the soaps without any wastage. Traditionally, soapboxes are designed to have short ribs, raised ridges, dowels, grills or racks to support the wet bar soaps above the floor of the soap box/dish.

In almost all the cases, the bars which support the bar soaps are flat, rectangular or circular in cross-section and they are not efficient to drain the water away from the wet soap surface. Water sticks to the bottom surface of the soap between the bars and slowly soaks the outer layer of the soap surface.

Most of the conventional soapboxes are designed to support soap bars in the horizontal position and due to the lack of any slope, water is retained on the top surface of the soap and this water slowly soaks the top surface of the soap. When the top surface of the soap is soaked, a thin film of soapy paste will be formed which in turn will retain some more water and damage the soap further.

Some of the designs like U.S. Pat. Nos. 5,253,752 and 5,232,189 employed the concept of inclined supporting members to support the wet soaps but these supporting members are too far apart to restrain the soap in position without falling between the members and touching the floor of the container. When the soap touches any part of the soap dish, the water will be trapped between the surfaces and the soap starts absorbing the water and starts to dissolve. Moreover, these designs were developed for the soap dishes to be supported on the walls or showerheads with elaborate system and are not adaptable for the compact boxes. The inventor did not find any patents that utilize the inclined supporting structure for the compact soapboxes.

In most soapbox designs, the space between the wet soap and the floor of the container is not designed to adequately drain the soapy water collected from the soap. Some of the containers are provided with small holes or narrow slots but they are not effective when the inverted top cover is placed under the bottom dish. Additionally, these holes or slots help the soapy water to escape from the box and create a mess during the storage stage. Apart from this, a large surface area of the soap touches the bottom of the perforated container and the water will thus be trapped between soap and the box bottom. When the wet bar soap touches any other surface, water will be retained between the surface and the soap. This retained water will be absorbed by the soap to form a soft paste.

Most soapboxes are not designed to tolerate any accidental overfill and when the shower water fills the box, the water will submerge the soap and destroy the soap.

SUMMARY OF INVENTION

The present invention, which will be described in detail with the help of drawings, rectifies all the above-mentioned shortcomings of conventional soapboxes.

The inventor invented the use of semi-circular bars to support the wet bar soaps. The flat surface of the bar bears against the wet soap with the curved surface below. Due to surface tension, a thin film of soapy water sticking to the soap bottom between the bars is drawn towards the bars. Since the rack-bars are inclined, the soapy water will be efficiently drained off without giving it chance to soak the soap.

The inventor designed the soap rack to keep the soap surface inclined so that the water drains quickly and efficiently due to gravity and will not have enough time to be absorbed by the soap.

In spite of the two design features mentioned above, a certain amount of water will still be trapped between the soap and the flat surface of the rack-bars and be absorbed by the soap to make a thin film of soapy paste. This film will eventually dry up and return to the soap since it cannot adhere to the non-stick surface of the rack-bar. The inventor designed the non-stick surface of the rack-bars for this purpose.

The bottom dish and its top cover are designed to make sure that the water in the bottom dish can't reach the soap rack to damage the soap. Even during the storage stage, the soap rack separates the soap and the wet container and prevents soap destruction.

DESCRIPTION OF THE DRAWINGS

The following brief description of the drawings is developed to familiarize the reader with the different components of the Soapbox designed by the inventor.

Figure 1:
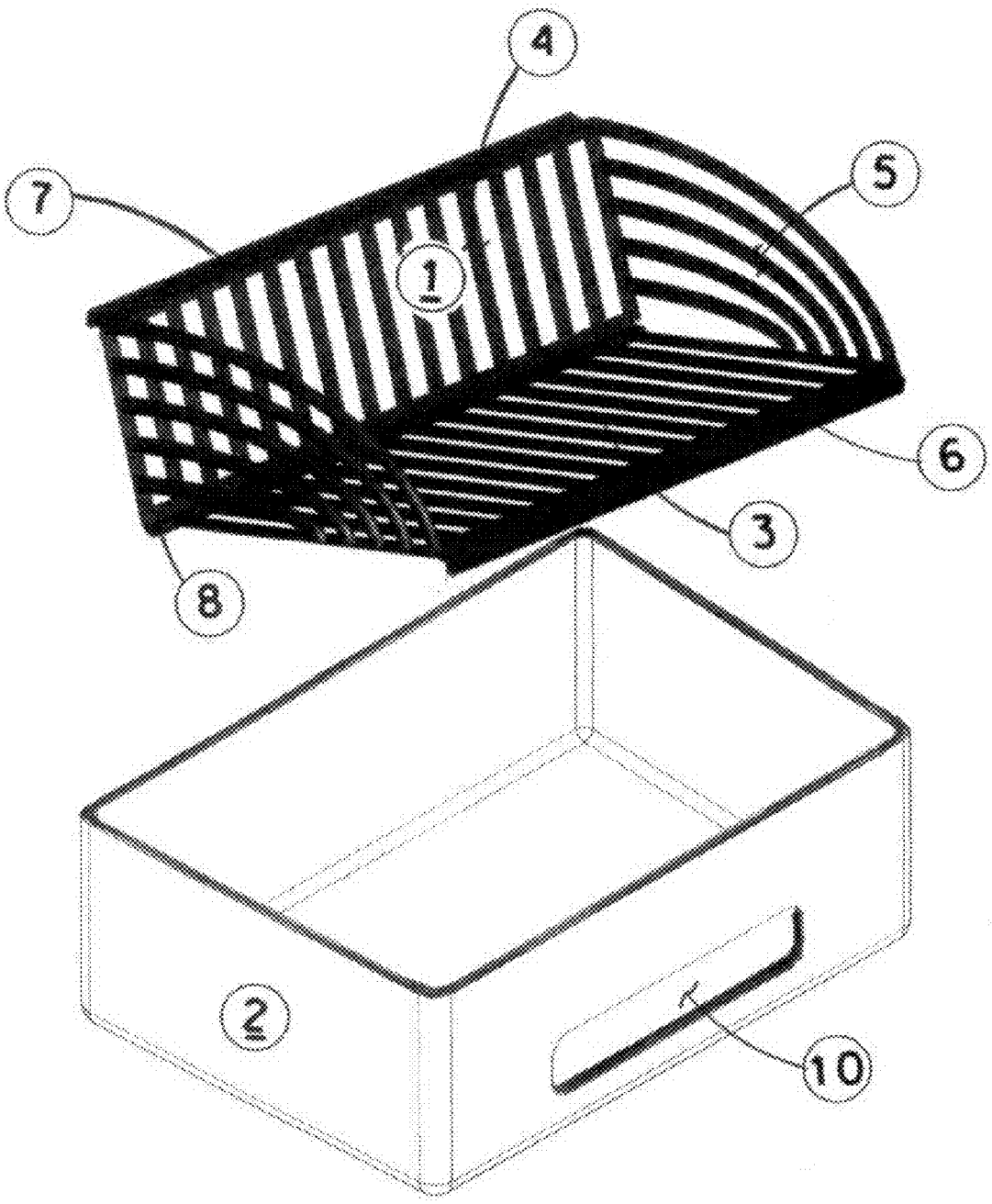
FIG. 1 is an exploded isometric view of the present invention. The soap rack (1) needs to be taken out of the bottom dish (2) before use. The soap rack (1) is made up of front supporting member (6), back supporting member (7), main cross-member (8) and several rack-bars (3, 4 and 5) all of which are fused together to form this monolithic rack (1). The cross-section of each of the rack-bar is semi-circular and is shown in FIG. 3 DETAIL. Only the bottom dish with its over flow opening (10) is shown here but the top cover is not shown in this figure for clarity.
Figure 2:
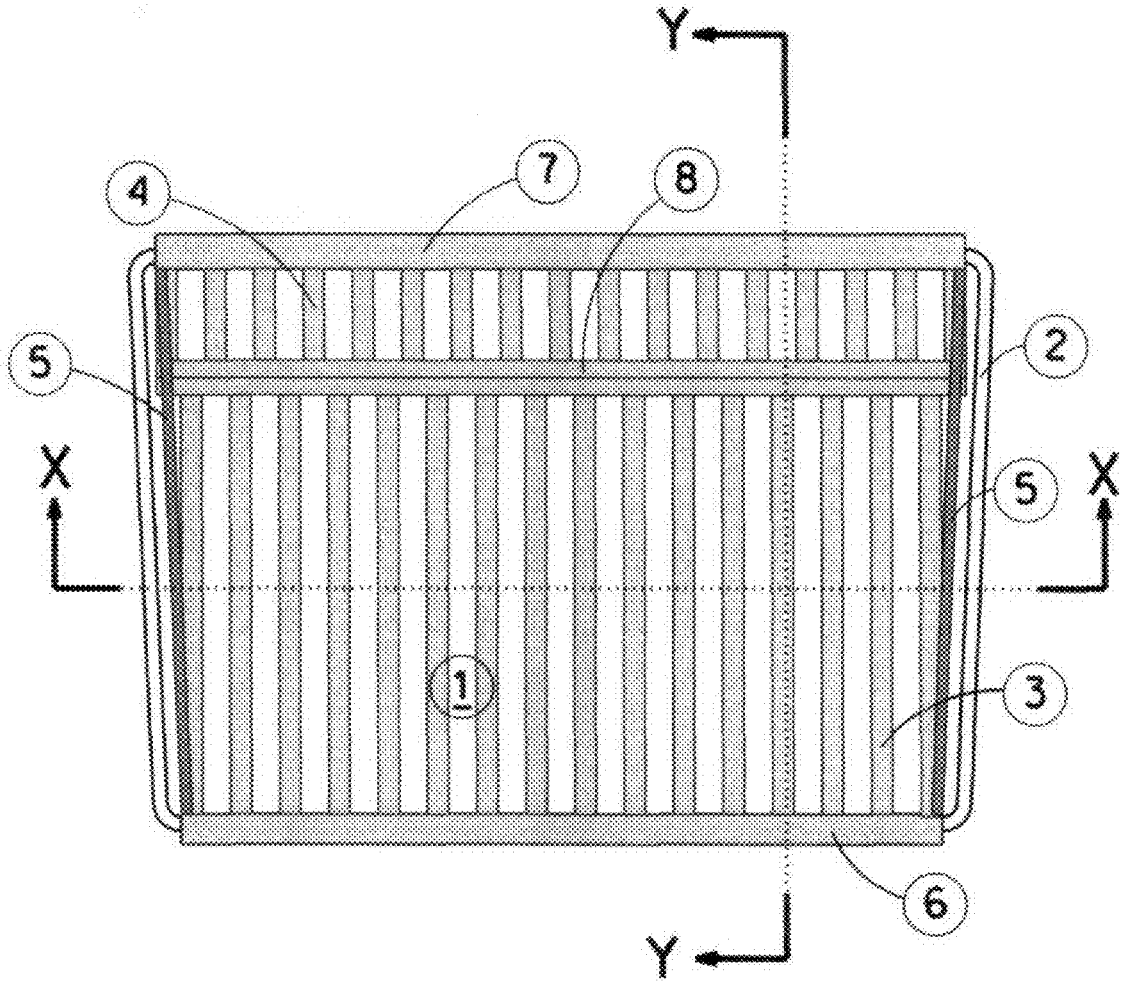
FIG. 2 is the plan view of the soap rack (1) when placed in the bottom dish (2) for use. As shown, the soap-rack snugly fits between two longer walls of the bottom dish (2). The bottom front supporting rack-bars (3) span across the front supporting member (6) and the main cross-member (8). In the same way, the bottom back supporting rack-bars (4) span across the back supporting member (7) and the main cross-member (8). Notice that the soap-rack is not supported on the shorter walls of the box. The side supporting rack-bars (5) form an elliptical enclosure, the details of which can be seen in FIG. 4.
Figure 3:
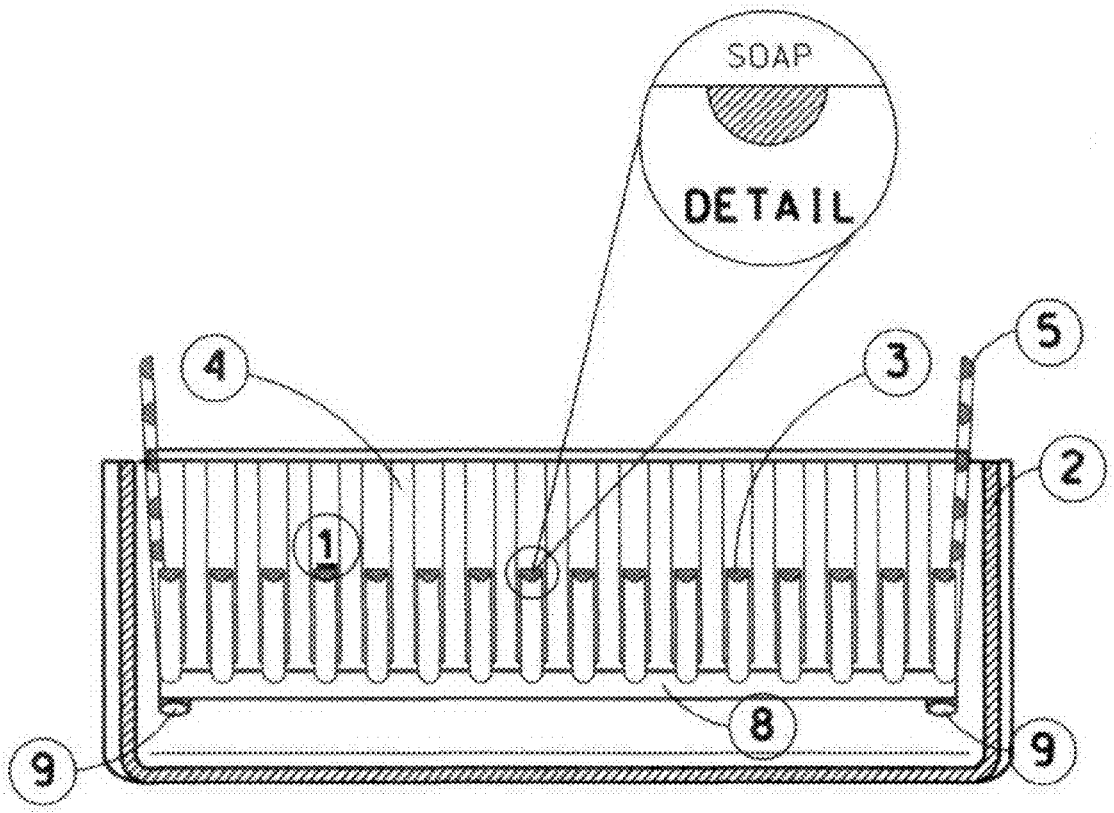
FIG. 3 is the cross-sectional view of Section-XX as indicated on FIG. 2. Notice the two short legs (9) on either side of the main cross-member (8). These legs will support the soap rack (1) when laid flat during the storage after use. This FIG. 3 also shows the DETAIL of the rack-bar cross-section. This cross-section is the typical transverse section of all the rack-bars (3, 4 and 5) and is taken perpendicular to the axis of the bars.
Figure 4:
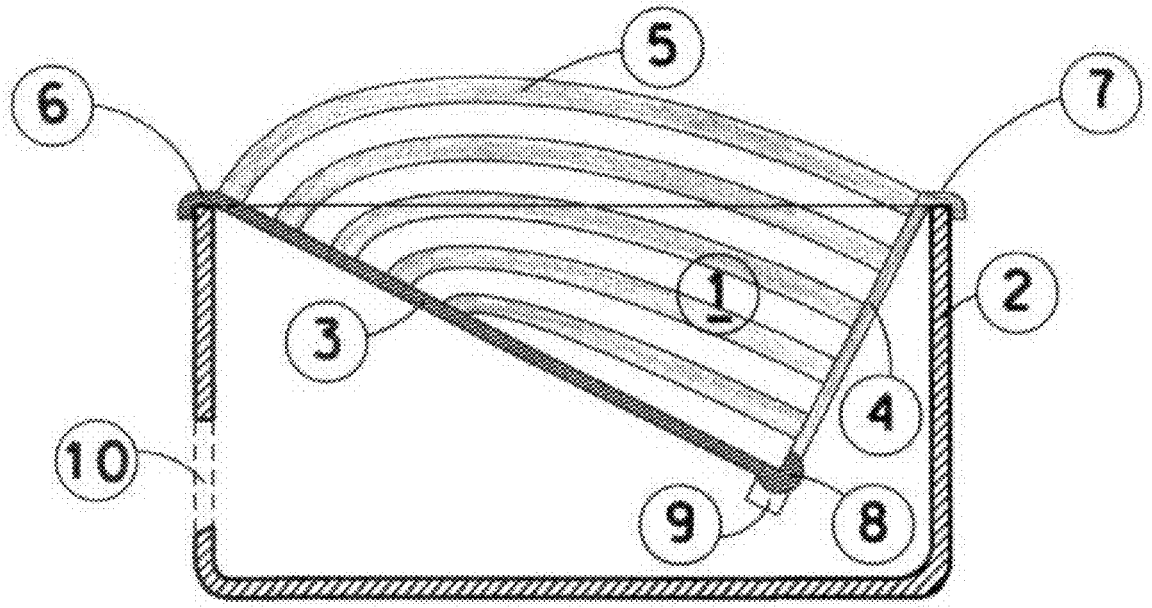
FIG. 4 is the cross-sectional view of Section-YY as indicated in FIG. 2. As shown in this figure, the soap rack (1) is supported on the bottom dish (2). The bottom front supporting rack-bars (3) span across the front supporting member (6) and the main cross-member (8). The bottom back supporting rack-bars (4) span across the back supporting member (7) and the main cross-member (8). The detailed layout of the side rack-bars (5) can be seen clearly here. The side semi-circular bars follow an elliptical shaped path between the end back support bars and the end front supporting bars. The overflow opening (10) is provided to drain off any excess water from the bottom dish (2) and prevents the water surface to reach the cross member (8).
Figure 5:
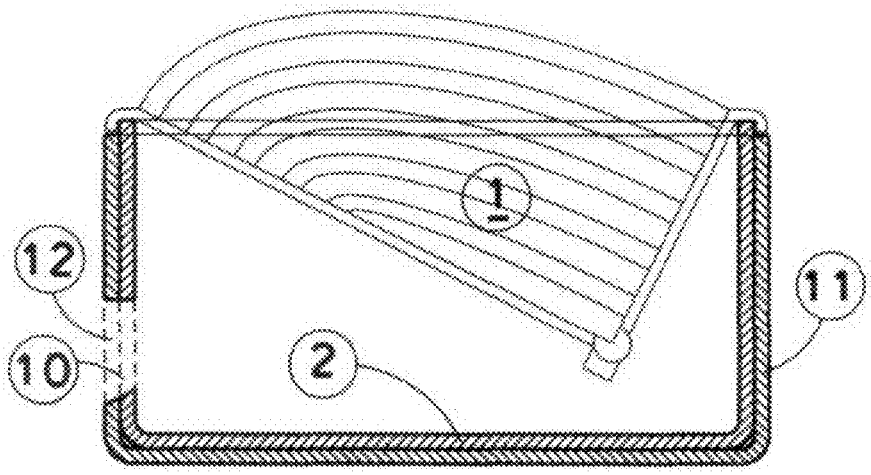
FIG. 5 shows two cross sectional views of the soapbox during and after use. This figure shows the general arrangement of the soap-rack (1), bottom dish (2) and the top cover (11) of the soapbox. Notice how the overflow opening (12) of the top cover (11) aligns with the over flow opening (10) of the bottom dish (2) during the use. After the use, the over flow openings will stagger to make a watertight soapbox to store the soap.
Figure 5:
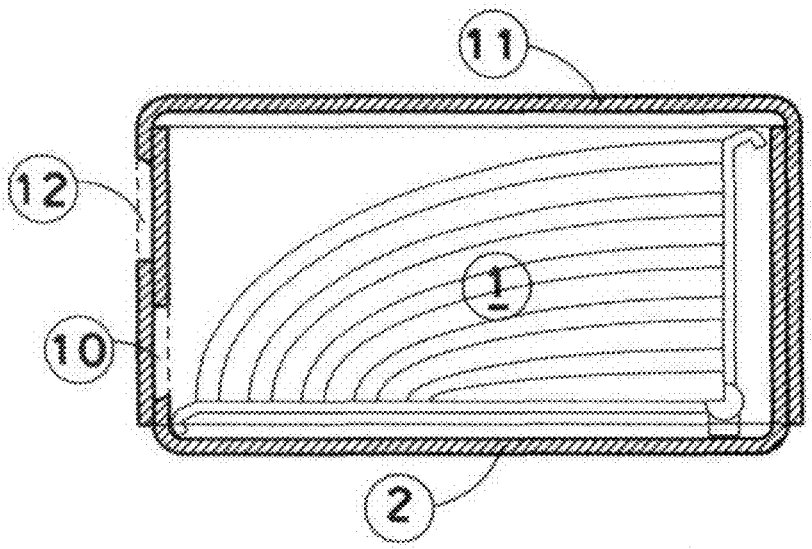

I claim that:

1. A soap box comprising:

a base dish having a base overflow opening in a base dish side wall;

a cover having a cover overflow opening in a cover side wall;

wherein said base overflow opening and said cover overflow opening align to allow the passage of liquid in a use configuration, and said base overflow opening and said cover overflow opening stagger to prevent the passage of liquid in a storage configuration; wherein when said cover is nested underneath said base dish in said use configuration aligning said base overflow opening and said cover overflow opening; and wherein when said cover is secured on top of said base dish in said storage configuration; said base dish side wall blocks said cover overflow opening and said cover side wall blocks said base overflow opening in said storage configuration; and a soap rack comprising bars with a semi-circular cross-section for receiving a soap bar on the flat side of said semi-circular cross-section;

wherein said soap rack extends from a base dish front wall to a base dish back wall in said use configuration, and said soap rack fits entirely within said base dish in said storage configuration.

2. The soap box of claim 1, wherein said base dish side wall coincides with said base dish back wall.

3. The soap box of claim 1, wherein said base dish and said cover have a trapezoidal shape.

4. The soap box of claim 1, wherein said soap rack comprises side bars having an elliptical shape.

5. The soap box of claim 1, wherein said soap rack has a non-stick surface on at least the flat side of the semi-circular bars.

6. The soap box of claim 1, wherein said soap rack further comprises short legs keeping said soap rack elevated from said base dish in said storage configuration.

7. The soap box of claim 1, wherein said soap rack in said use configuration is inclined at an angle of between 10° and 50° from said base dish.

8. The soap box of claim 7, wherein said soap rack in said use configuration is inclined at an angle of 27° from said base dish.

* * * * *